US009644338B1

(12) United States Patent
Bisson

(10) Patent No.: US 9,644,338 B1
(45) Date of Patent: May 9, 2017

(54) SLUICE SUPPORT

(71) Applicant: William Bisson, Metaline, WA (US)

(72) Inventor: William Bisson, Metaline, WA (US)

(73) Assignee: William Bisson, Metaline, WA (US)

( * ) Notice: Subject to any disclaimer, the term of this patent is extended or adjusted under 35 U.S.C. 154(b) by 0 days.

(21) Appl. No.: 15/249,711

(22) Filed: Aug. 29, 2016

(51) Int. Cl.

| | |
|---|---|
| ***E02B 8/02*** | (2006.01) |
| ***E02B 8/04*** | (2006.01) |
| ***B03B 5/26*** | (2006.01) |
| ***E02D 27/52*** | (2006.01) |
| ***E02D 27/50*** | (2006.01) |

(52) U.S. Cl.
CPC ..... *E02D 27/52* (2013.01); *B03B 5/26* (2013.01); *E02B 8/023* (2013.01); *E02B 8/04* (2013.01); *E02D 27/50* (2013.01)

(58) Field of Classification Search
CPC ..... B03B 5/00; B03B 5/26
See application file for complete search history.

(56) References Cited

U.S. PATENT DOCUMENTS

| | | | | | |
|---|---|---|---|---|---|
| 289,018 | A * | 11/1883 | Miller | B03B 5/26 | 209/442 |
| 386,030 | A | 7/1888 | Rae | | |
| 1,069,244 | A * | 8/1913 | Rae | B07B 1/22 | 209/284 |
| 1,243,395 | A | 10/1917 | Fellows | | |
| 2,312,096 | A | 2/1943 | Holt et al. | | |
| 2,923,410 | A | 2/1960 | Tschmelitsch | | |
| 4,142,965 | A | 3/1979 | Dolan | | |
| 4,199,441 | A | 4/1980 | Ross | | |
| 4,319,985 | A * | 3/1982 | Hibbard | B03B 5/26 | 209/3 |
| 4,339,043 | A * | 7/1982 | Tice | B03B 5/26 | 209/251 |
| 4,360,424 | A | 11/1982 | Pearson et al. | | |
| 4,592,833 | A | 6/1986 | Perdue | | |
| 4,860,874 | A * | 8/1989 | Winderl | B03B 5/26 | 193/2 B |
| D631,900 | S * | 2/2011 | Prochaska | D15/147 | |
| 8,616,379 | B2 | 12/2013 | Alderson et al. | | |
| D768,745 | S * | 10/2016 | Vetter | D15/147 | |
| 2008/0163915 | A1 | 7/2008 | Wobrock | | |
| 2009/0078615 | A1* | 3/2009 | Rainwater | B03B 5/26 | 209/44 |
| 2010/0193406 | A1* | 8/2010 | Alderson | B03B 9/00 | 209/44 |
| 2010/0236993 | A1 | 9/2010 | Goodrich et al. | | |
| 2011/0186486 | A1* | 8/2011 | Alderson | B03B 5/26 | 209/458 |

FOREIGN PATENT DOCUMENTS

| | | | |
|---|---|---|---|
| CA | 1074263 | A1 | 3/1980 |

* cited by examiner

*Primary Examiner* — Tara M. Pinnock
(74) *Attorney, Agent, or Firm* — Randall Danskin P.S.

(57) ABSTRACT

A sluice support for positionally supporting a sluice box within a waterway provides an anchor post, an axially and rotatably movable slide hammer and two adjustably positionable support frames releasably engageable with the slide hammer to adjustably support a sluice box within a waterway.

9 Claims, 4 Drawing Sheets

SLUICE SUPPORT

RELATED APPLICATIONS

There are no patent applications related hereto filed in the United States, nor in any foreign country.

BACKGROUND OF INVENTION

Field of Invention

The present invention relates generally to the field of placer mining, and more specifically relates to an infinitely adjustable support for a sluice box to positionally maintain a sluice box in a waterway at an optimal orientation and angulation.

Background and Description of the Related Art

The purpose of a gold sluice is to separate heavier gold bearing materials from placer sand and gravel. The separation is accomplished by use of flowing water through the sluice. By placing an amount of placer gravel and sand materials at an upper end of the sluice, and utilizing water flowing over a series of riffles on the sluice, the heavier gold bearing materials are separated out of the slurry. This is accomplished by the heavier materials collecting in a low-pressure eddy area behind the riffle devices.

In order for optimum separation to take place, it is necessary for the flow of water over, and through the sluice to be accurately controlled. Present practice by prospectors in the field has been to set the sluice box into a flowing stream or waterway and thereafter adjust to the position, orientation and particularly the angulation of the sluice box using rocks, stones and whatever materials are locally available. This process is difficult and time-consuming and requires alteration of the stream/waterway because large rocks and stones must be used to support the sluice box as desired. Such use of rocks, stones and local materials is difficult and time-consuming and is never overly precise. Further, because the water level in such creeks and waterways varies, the height adjustability is minimal and difficult, and maintaining the sluice box in a level orientation is particularly difficult because quantities of heavy placer gravel and sand and rocks are repeatedly shoveled onto the upper surface of the sluice box. Therefore not only is elongate support to accurately maintain the front to rear angulation important and difficult, but rotational support of the sluice box is also necessary and difficult to maintain. As a result, most sluice boxes cannot be consistently operated in an optimum fashion.

There is therefore a continuing need for a means and apparatus to quickly and easily and accurately adjust the position, angulation and support for a sluice box for prospecting operations. Further, there is a need for such an apparatus that does not require physical alteration of the stream/waterway and the flow of water therethrough, and the support means needs to be easily removable and transportable.

Some or all of the problems, difficulties and drawbacks identified above and other problems, difficulties, and drawbacks may be helped or solved by the inventions shown and described herein. My invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel inventions shown and described herein.

BRIEF SUMMARY OF THE INVENTION

A sluice support for positionally supporting a sluice box within a waterway provides an anchor post, an axially and rotatably movable slide hammer and two adjustably positionable support frames releasably engageable with the slide hammer to adjustably support a sluice box within a waterway.

A first aspect of the instant invention is a sluice support having an anchor post with a soil penetrating first end and an opposing second end, the anchor post further having an outwardly facing surface and a length between the first end and the second end; a slide hammer axially and rotatably engageable with the anchor post, the slide hammer having an open first end, an opposing closed second end, a hammer mass, an outwardly facing surface and a length between the open first end and the closed second end. The slide hammer further defines an axial medial channel communicating with the open first end and extending partially along the length toward the closed second end. A first support frame having a collar defining a medial channel through which the slide hammer axially extends, an extension arm extending angularly radially from the collar, and wherein the extension arm has an end distal from the collar. A cross arm carried at the end distal from the collar, the cross arm having a first end and a second end with a medial channel extending therebetween, each end carrying a telescoping width adjustable rod having a sluice fastening plate for attachment to opposing side portions of the sluice box. A second support frame having a collar defining a medial channel through which the slide hammer axially extends and a cross arm carried on an outer circumferential surface of the collar extending generally perpendicular to the medial channel, the cross arm having a first end and a second end with a medial channel extending therebetween, each end of the cross arm carrying a telescoping width adjustable rod having a sluice fastening plate for attachment to opposing side portions of the sluice box proximate the first end of the sluice box.

A second aspect of the present invention is a sluice support having a fastener carried by the first support frame collar and a fastener carried by the second support frame collar, and the fasteners positionally secure the first support frame collar and the second support frame collar to an outwardly facing surface of the slide hammer.

A third aspect of the present invention is a sluice support wherein the first support frame collar fastener and the second support frame collar fastener engage with an outwardly facing surface of the anchor post.

A fourth aspect of the present invention is a sluice support wherein the first support frame collar is adjustably positionable relative to the open first end and closed second end of the slide hammer and the second support frame collar is adjustably positionable relative to the open first end and closed second end of the slide hammer and a distance between the first support frame collar and the second support frame collar adjusts angulation of the sluice box in the waterway and volume of water flowing along and over and through the sluice box.

A fifth aspect of the present invention is a sluice support wherein the slide hammer is axially rotatable relative to the anchor post.

A sixth aspect of the present invention is a sluice support having an anchor post for releasably and adjustably anchoring the sluice support in a waterway, the anchor post having a soil penetrating first end and a second end with a length between the soil penetrating first end and the second end and further having an outer circumferential surface. A slide hammer slidably axially engageable with the anchor post, the slide hammer having an open first end, a closed second end, a length between the open first end and the closed second end and having a hammer mass, the slide hammer further defining an axially aligned medial channel communicating with the open first end and extending partially along the length toward the closed second end, the slide hammer further having an outwardly facing surface. A first support frame adjustably positionally engageable with the slide hammer, the first support frame having an adjustably positionable collar defining a medial channel through which the slide hammer axially extends, the adjustably positionable collar having an extension arm extending angularly and generally radially from the collar. The extension arm has a first end communicating with an outer circumferential surface of the collar, and a second end distal from the collar, and a cross arm carried at the second end of the extension arm that extends general perpendicularly to the collar medial channel. The cross arm has a first end and a second end and a defines a medial channel communicating therebetween, the first end and the second end each carrying a telescoping width adjustable rod having a sluice fastening plate at one end thereof for attachment to opposing side portions of the sluice box. A second support frame adjustably positionally engageable with the slide hammer, the second support frame having an adjustably positionable collar defining a medial channel through which the slide hammer axially extends and wherein the collar has a cross arm carried on an outer circumferential surface of the collar that extends generally perpendicularly to the collar medial channel, the cross arm having a first end and a second end and defining a medial channel communicating therebetween, and the first end and the second end of the cross arm each carrying a telescoping width adjustable rod having a sluice fastening plate at one end thereof for attachment to opposing side portions of the sluice box proximate the first end of the sluice box.

Other and further aspects of my invention will appear from the following specification and accompanying drawings which form a part hereof. In carrying out the aspects and objects of my invention it is to be understood that its structures and features and steps are susceptible to change in design and arrangement and order with only one embodiment being illustrated in the accompanying drawings and specified as is required.

BRIEF DESCRIPTION OF THE DRAWING

Disclosed forms, configurations, embodiments and/or diagrams relating to and helping to describe aspects and versions of my invention are explained and characterized herein, often with reference to the accompanying drawings. The drawings and features shown herein also serve as part of the disclosure of my invention, whether described in text or merely by graphical disclosure alone. The drawings are briefly described below.

DETAILED WRITTEN DESCRIPTION

Introductory Notes

Figure 1:
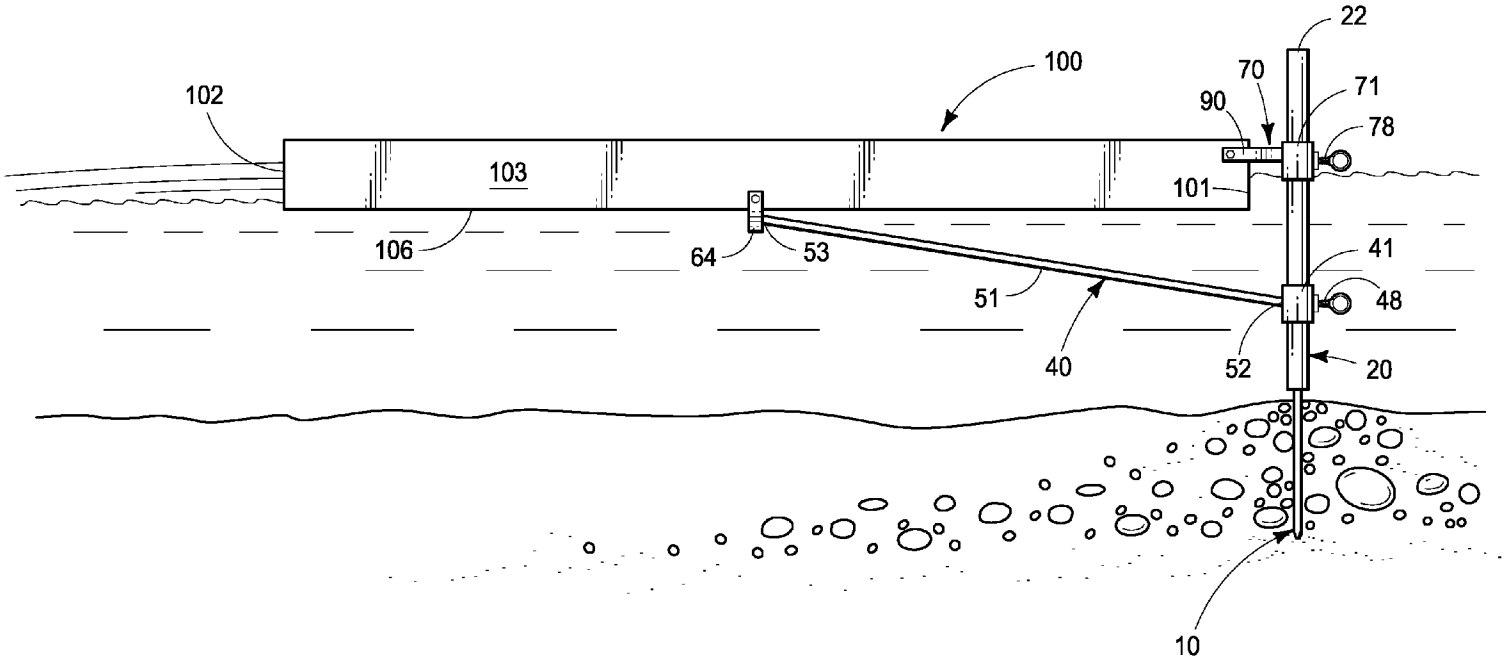
FIG. 1 is an orthographic side view of my sluice support anchored in a waterway and supporting a sluice box within the waterway allowing the water to flow over, around and through the sluice box.
Figure 2:
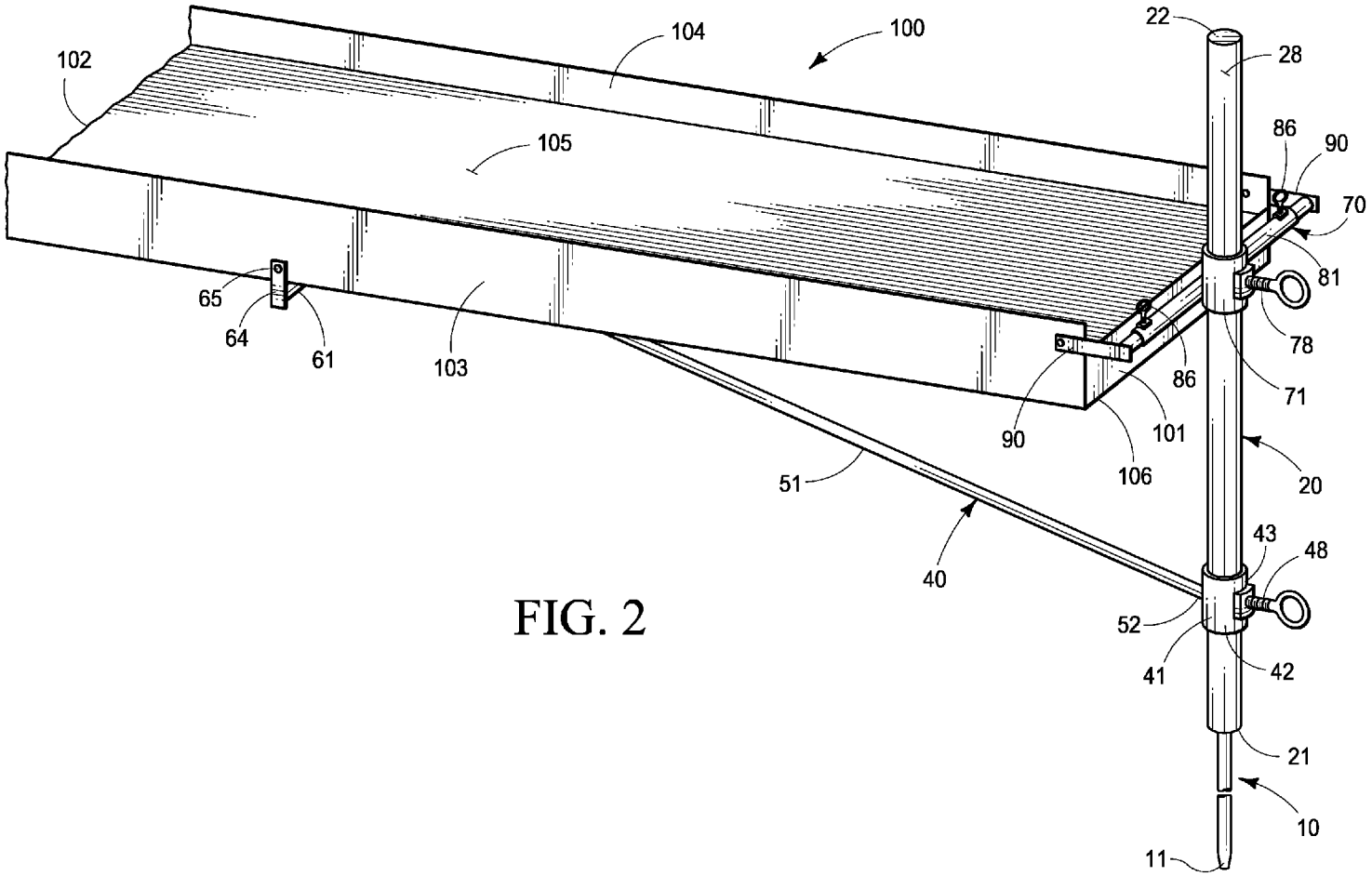
FIG. 2 is an enlarged isometric top, first end and side view of the sluice support supporting a sluice box.

The readers of this document should understand that dictionaries were used in the preparation of this document. Widely known and used in the preparation hereof are *The American Heritage Dictionary of the English Language,* 4th Edition (© 2000), *Webster's New International Dictionary*, Unabridged, (Second Edition©1957), *Webster's Third New International Dictionary* (© 1993), *The Oxford English Dictionary* (Second Edition, ©1989), and *The New Century Dictionary* (©2001-2005), all of which are hereby incorporated by this reference for interpretation of terms used herein and to more adequately or aptly describe various features, aspects and concepts shown or otherwise described herein using words having meanings applicable to such features, aspects and concepts.

This document is also premised upon using one or more terms with one embodiment that may also apply to other embodiments for similar structures, functions, features and aspects of the inventions. Wording used in the claims is also descriptive of the inventions, and the text of both Claims and Abstract are incorporated by this reference into the description entirely.

The readers of this document should further understand that the embodiments described herein may rely on terminology and features used in any section or embodiment shown in this document and other terms readily apparent from the drawings and language common or proper therefore.

My invention is for use with a sluice box 100 which is most commonly a rectangular placer mining apparatus having an up-stream first end 101, an opposing down-stream second end 102, a first side 103, a spaced apart second side 104, a top 105 and an opposing bottom 106. For optimal performance, the sluice box 100 needs to be positionally supported within a waterway so that water flows along and through the sluice box 100 from the first end 101 to the second end 102 between the first side 103 and the second side 104 and over the top 105. Such positioning generally requires a dike, or other stable structure, to be constructed within a waterway and the sluice box 100 positioned thereon. Proper angulation of the sluice box 100 within the waterway and proper current flow there-over are critical to the optimum operation of the sluice box 100 and separation of gold from waste materials.

My sluice support generally provides an anchor post 10, a slide hammer 20, a first support frame 40 and a second support frame 70 for adjustably and positionally supporting a sluice box 100 with a waterway.

The anchor post 10 is elongate and rod-like in configuration and is preferably formed of steel or a material having similar strength and durability characteristics. The anchor post 10 has a first end 11, a second end 12 and a length 13 extending between the first end 11 and the second end 12. The anchor post 10 further has a diameter 14 and an outwardly facing surface 15. In the preferred embodiment, the anchor post 10 is solid, but it is also contemplated the anchor post may also be tubular and may have a peripheral configuration than cylindrical. In on embodiment the anchor post 10 carries a diametrically enlarged bulb 16 along the length 13 and which may be proximate the second end 12.

The slide hammer 20 is generally tubular in configuration having an open first end 21 and a closed second end 22 with a length 23 between the open first end 21 and the closed second end 22. The slide hammer 20 further has a hammer mass 25 and an axially aligned medial channel 26 is defined by the slide hammer 20 and communicates with the open first end 21. The axially aligned medial channel 26 has an internal diameter 30 and extends partially along the length 23 of the slide hammer 20 from the open first end 21 to a terminal end 24 proximate the closed second end 22. The hammer mass 25 may be concentrated proximate the closed second end 22 of the slide hammer 20, such as by having an additional mass located thereat, or thickening the walls thereat, but the hammer mass 25 also includes the entire mass of the slide hammer 20 and is integral with the slide hammer 20. The axially aligned medial channel 26 has a peripheral configuration that is complementary to the peripheral configuration of the anchor post 10 so that the anchor post 10 is axially and rotatably movable within the medial channel 26. The length 31 of the medial channel 26 is less than the length 13 of the anchor post 10. The slide hammer 24 further has an outwardly facing surface 28 extending thereabout.

In one embodiment the slide hammer 20 carries a collar 32 at the open first end 21. The collar 32 defines an axial medial channel 33 that has a diameter (not shown) that is slightly larger than the diameter 14 of the anchor post 10 but smaller than the diameter (not shown) of the diametrically enlarged bulb 16. The collar 32 provides a means for retaining the anchor post 10 within the medial channel 23 of the slide hammer 20 to prevent its being lost, and further provides a means to "up-hammer" the slide hammer 20 relative to the anchor post 10 to ease removal of the anchor post 10 from a water-way bed.

Figure 3:
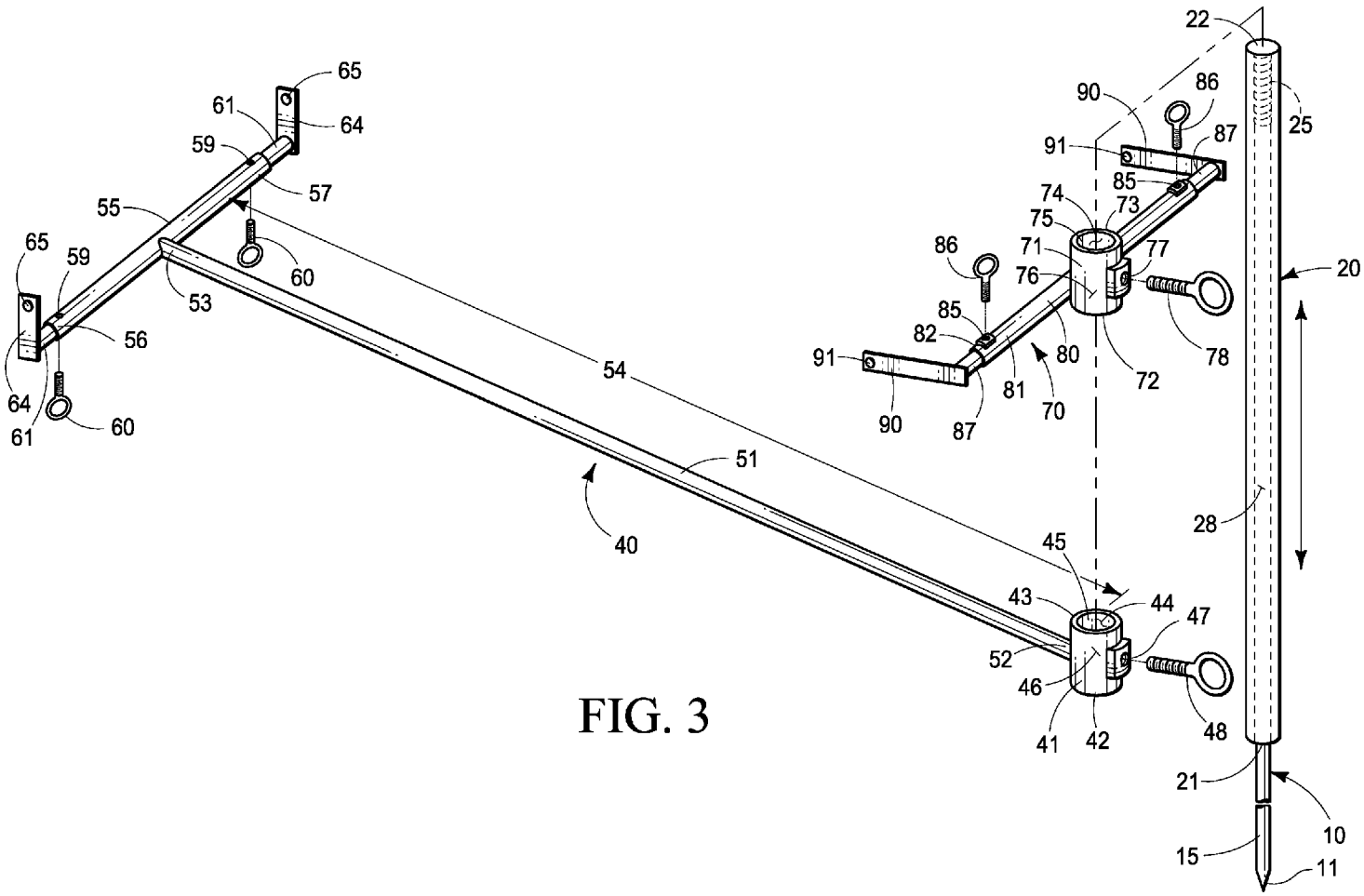
FIG. 3 is an exploded isometric top, first end and side view of the sluice support showing arrangement of the components.
Figure 4:
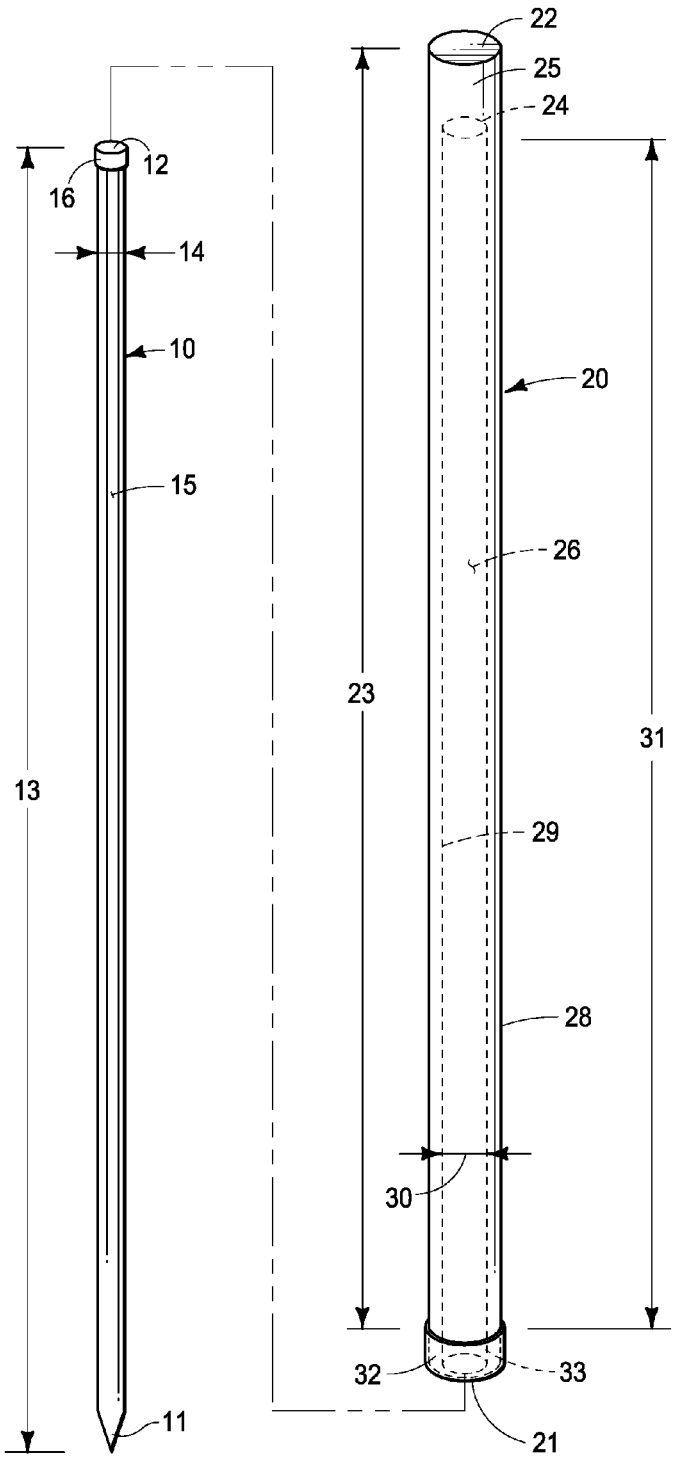
FIG. 4 is an enlarged isometric top and side view of the anchor post and slide hammer showing the medial channel defined by the slide hammer.

As shown in FIG. 3, the first support frame 40 has a collar 41 that defines a channel 44 extending from a first end 42 to a second end 43 and the collar 41 further has an outer circumferential surface 46 and an inner circumferential surface 45 within the channel 44. A threaded hole 47 communicates between the outer circumferential surface 46 and the inner circumferential surface 45 and carries a threaded fastener 48 so that the collar 41 may be adjustably positionally secured to the outwardly facing surface 28 of the slide hammer 20 or possibly the outwardly facing surface 15 of the anchor post 10. An extension arm 51 having a first end 52 and a second end 53 with a length 54 therebetween extends angularly radially from the outer circumferential surface 46 of the collar 41 so that the second end 53 is distal from the collar 41. In another contemplated embodiment (not shown), the extension arm 51 is telescopingly extendable and collapsible. A cross arm 55 is carried at the second end 53 of the extension arm 51 and is oriented generally perpendicularly to the medial channel 44. The cross arm 55 has a first end 56 and a second end 57 and defines a medial channel (not shown) extending therethrough so that a width adjustable rod 61 is positionally and adjustably carried within the medial channel at each end 56, 57. The width adjustable rod 61 is adjustably telescopingly extendable from the first end 56 and the second end 57 of the cross arm 55 to accommodate varying widths of the sluice box 100. A threaded hole 59 is defined in the cross arm 55 proximate the first end 56 and proximate the second end 57 to threadably carry a threaded cross arm fastener 60.

Each width adjustable rod 61 has an end portion (not shown) that is axially inserted into the medial channel defined by the cross arm 55 and an opposing end portion that carries a sluice fastening plate 64. Each sluice fastening plate 64 defines a fastener hole 65 for a fastener (not shown) to extend therethrough and releasably engage with a side 103, 104 of the sluice box 100.

The second support frame 70 has a collar 71 that defines a channel 74 extending from a first end 72 to a second end 73 and the collar 71 further has an outer circumferential surface 76 and an inner circumferential surface 75 within the channel 74. A threaded hole 77 communicates between the outer circumferential surface 76 and the inner circumferential surface 75 and carries a threaded fastener 78 so that the collar 71 may be adjustably positionally secured to the outwardly facing surface 28 of the slide hammer 20 or possibly the outwardly facing surface 15 of the anchor post 10. A cross arm 81 is carried on the outer circumferential surface 76 and extends generally perpendicularly to the medial channel 74. The cross arm 81 has a first end 82 and a second end 83. In the preferred embodiment, the cross arm 81 is tubular defining a medial channel (not shown) so that a width adjustable rod 87 is positionally and adjustably carried within the medial channel and is adjustably extendable from the first end 82 and the second end 83 of the cross arm 81 to accommodate varying widths of the sluice box 100. A threaded hole 85 is defined in the cross arm 81 proximate the first end 82 and proximate the second end 83 to threadably carry a threaded cross arm fastener 86.

Each width adjustable rod 87 has an end portion (not shown) that is axially inserted into the medial channel defined by the cross arm 81 and an opposing end portion that carries a sluice fastening plate 90. Each sluice fastening plate 90 defines a fastener hole 91 for a fastener (not shown) to extend therethrough and releasably engage with a side 103, 104 of the sluice box 100.

Having described the structural my sluice support its operation may be understood.

After a desirable location within a stream, or creek, or waterway has been determined, the operator positions the anchor post 10 generally vertically with the first end 11 resting directly upon the waterway bed preferably between any large rocks and the like so that the anchor post 10 may penetrate the bed surface within the waterway. The slide hammer 20 is axially engaged with the anchor post 10 by inserting the second end 12 of the anchor post 10 into the open first end 21 of the slide hammer 20 so that a portion of the length 13 of the anchor post 10 is within the medial channel 26 defined by the slide hammer 20.

The slide hammer 20 is reciprocally moved upwardly and forcefully downwardly on the anchor post 10 by the operator so that the slide hammer 20 and the hammer mass 25 pounds/drives the first end 11 of the anchor post 10 into the waterway bed some portion of the length 13 of the anchor post 10. Once the anchor post 10 is driven vertically into the waterway bed to a desirable depth, the reciprocal movement of the slide hammer 20 thereon is stopped.

The collar 41 of the first support frame 40 is aligned with the slide hammer 20 so that the closed second end 22 of the slide hammer 20 slides into and through the channel 44 defined by the collar 41. The collar 41 is moved along the length 23 of the slide hammer 20 toward a position somewhat medially between the open first end 21 and the closed second end 22. Once located at a desired position the collar 41 is positionally secured to the outwardly facing surface 28 of the slide hammer 20, or the anchor post 10, by tightening the fastener 48.

A width adjustable rod 61 is aligned with each of the first end 56 and the second end 57 of the medial channel (not shown) defined by the cross arm 55 carried at the second end of the extension arm 51. The end portion of each width adjustable rod 61 not carrying the sluice fastening plate 64 is axially inserted into the medial channel of each end 56, 57 of the cross arm 55 and each width adjustable rod 61 is positionally secured within the cross arm 55 by tightening the cross arm fasteners 60. Spacing between the sluice fastener plates 64 should be sufficient to allow the sluice box 100 to be positioned between the two sluice fastening plates 64.

Thereafter, the collar 71 of the second support frame 70 is aligned with the slide hammer 20 so that the closed second end 22 of the slide hammer 20 slides into and through the channel 74 defined by the collar 71. The collar 71 is moved along the length 23 of the slide hammer 20 to a position spacedly adjacent the closed second end 22 and spacedly above the first collar 41. Once located at a desired position, the collar 71 is positionally secured to the outwardly facing surface 28 of the slide hammer 20, or the anchor post 10, by tightening the fastener 78.

A width adjustable rod 87 is aligned with each of the first end 82 and the second end 83 of the medial channel (not shown) defined by the cross arm 81 carried by the collar 71. The end portion of each width adjustable rod 87 not having the sluice fastening plate 90 is axially inserted into the medial channel of each end 82, 83 of the cross arm 81 and each width adjustable rod 87 is positionally secured within the cross arm 81 by tightening the cross arm fasteners 86. The spacing between the sluice fastener plates 90 should be sufficient to allow the sluice box 100 to be positioned between the two sluice fastening plates 90.

The sluice box 100 is positioned on the sluice support so that the first end 101 of the sluice box 100 is adjacent the second support frame 70 and the two sluice fastening plates 90 carried by the width adjustable rods 87 are positioned adjacent the first side 103 and the second side 104 of the sluice box 100. Fasteners (not shown) are inserted through the fastener holes 91 defined in the sluice fastening plates 90 to engage with the side portions 103, 104 of the sluice box 100 to positionally secure the first end 101 of the sluice box 100 to the second support frame 70.

The width adjustable rods 61 carried by the first support frame 40 cross arm 55 are positionally adjusted relative to the cross arm 55 and the sides 103, 104 of the sluice box 100 so that fasteners (not shown) may be inserted through the fastener holes 65 defined in the sluice fastening plates 64 to engage with the sluice box 100 sides 103, 104 to positionally secure the sluice box 100 to the first support frame 40.

The vertical positions of the first support frame 40 on the slide hammer 20 (or anchor post 10) and the vertical position of the second support frame 70 on the slide hammer 20 (or anchor post 10) relative to the level of the water in the waterway are adjusted as desired by loosening and tightening the fasteners 48, 78 to obtain optimal water flow over and through the sluice box 100. Increasing the vertical distance between the first collar 41 and the second collar 71 increases the angulation of sluice box 100 from the first end 101 to the second end 102 and decreasing the distance between the collars 41, 71 similarly reduces the angulation of the sluice box 100.

The axial rotatable interconnection of the slide hammer 20 on the anchor post 10 allows the sluice box 100 to pivot with the current of the water in the water course to maximize efficiency of the sluice box 100.

To remove the sluice 100 from the waterway, such as when mining is complete or another location is to be mined, the process described above is generally reversed. If the collar 32 and diametrically enlarged bulb 16 are carried by the slide hammer 20 and anchor post 10 respectively, the slide hammer 20 may be used to "up hammer" the anchor post 10 to ease its removal from the waterway bed.

Various portions and components of the instant invention, including for example, but not limited to, structural components, can be formed by one or more various manufacturing processes known to those in the art.

This disclosure and description has set out various features, functions, methods capabilities, uses and other aspects of my invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, disclosed, described and claimed herein. Also included are equivalents of the inventions which can be made without departing from the scope of concepts properly protected hereby.

Having thusly described and disclosed my Sluice Support I file this Utility Patent Application and pray issuance of Utility Letters Patent.

I claim:

1. A sluice support comprising:

an anchor post having a soil penetrating first end and a second end with a length between the first end and the second end and further having an outer circumferential surface;

a slide hammer axially and rotatably engageable with the anchor post, the slide hammer having an open first end, a closed second end, a length between the open first end and the closed second end, an outwardly facing surface and the slide hammer further defines an axial medial channel communicating with the open first end and extending partially along the length toward the closed second end;

a first support frame having a collar defining a channel through which the slide hammer axially extends, an extension arm extending angularly from the collar and wherein the extension arm has a second end distal from the collar, and a cross arm at the second end, the cross arm having opposing ends and each opposing end is attachable to the sluice to provide support to the sluice; and a second support frame having a collar defining a channel through which the slide hammer axially extends and a cross arm carried on an outer circumferential surface of the collar extending generally perpendicularly from the collar medial channel, the cross arm having opposing ends and each opposing end is attachable to the sluice to provide support to the sluice proximate the first end of the sluice.

2. The sluice support of claim 1 further comprising:

a fastener carried by the first support frame collar and a fastener carried by the second support frame collar, and wherein the fasteners adjustably positionally secure the first support frame collar and the second support frame collar to the slide hammer.

3. The sluice support of claim 1 wherein the first support frame collar and the second support frame collar engage with the anchor post.

4. The sluice support of claim 3 further comprising:

a fastener carried by the first support frame collar and a fastener carried by the second support frame collar, and wherein the fasteners positionally secure the first support frame collar and the second support frame collar to the outer circumferential surface of the anchor post.

5. The sluice support of claim 1 wherein the first support frame is adjustably positionable relative to the open first end and closed second end of the slide hammer and the second support frame is adjustably positionable relative to the open first end and closed second end of the slide hammer, and a distance between the first support frame and the second support frame adjusts angulation of the sluice in the waterway and volume of water flowing along and over the sluice.

6. The sluice support of claim 1 wherein the slide hammer is axially rotatable relative to the anchor post.

7. The sluice support of claim 1 wherein the extension arm of the first support frame is axially telescopingly extendable and collapsible.

8. The sluice support of claim 1 further comprising:

a medial channel defined by each cross arm of each support frame, each medial channel communicating between the first end and the second end of each cross arm;

an axially telescoping width adjusting rod carried in the medial channel at each end of each cross arm, each telescoping width adjusting rod having an end that axially engages with the medial channel defined by the cross arm and an opposing end portion carrying a sluice fastening plate; and a cross arm fastener carried in a threaded hole defined in each cross arm proximate to each end of each cross arm, the cross arm fastener providing a means to positionally secure the telescoping width adjusting rods within the cross arm medial channel.

9. A sluice support comprising:

an anchor post for releasably and adjustably anchoring the sluice support in a waterway, the anchor post having a soil penetrating first end and a second end with a length between the soil penetrating first end and the second end and an outer circumferential surface;

a slide hammer slidably axially engageable with the anchor post, the slide hammer having an open first end, a closed second end, a length between the open first end and the closed second end and a hammer mass at the closed second end, the slide hammer further defining an axially aligned medial channel communicating with the open first end and extending partially along the length toward the closed second end and the hammer mass; and the slide hammer having an outwardly facing surface;

a first support frame positionally engageable with the slide hammer, the first support frame having, an adjustably positionable collar defining a medial channel through which the slide hammer axially extends, the adjustably positionable collar having an extension arm extending angularly from the collar and wherein the extension arm has a first end communicating with an outer circumferential surface of the collar, and a second end distal from the collar, and a cross arm carried at the second end of the extension arm, the cross arm having a first end and a second end and defining a medial channel therebetween, the first end and the second end each axially carrying a telescoping width adjustable rod in the medial channel, each width adjustable rod having sluice fastening plate at one end thereof for attachment to opposing sides of the sluice between first and second ends of the sluice, and the cross arm further carrying threaded fasteners to positionally secure the width adjustable rods within the medial channel of the cross arm;

a second support frame adjustably positionally engageable with the slide hammer, the second support frame having an adjustably positionable collar defining a medial channel through which the slide hammer axially extends and wherein the collar has a cross arm carried on an outer circumferential surface of the collar, the cross arm having a first end and a second end and defining a medial channel therebetween the first end and the second end each axially carrying a telescoping width adjustable rod in the medial channel, each width adjustable rod having sluice fastening plate at one end thereof for attachment to opposing sides of the sluice proximate the first end of the sluice, and the cross arm further carrying threaded fasteners to positionally secure the width adjustable rods within the medial channel of the cross arm.

* * * * *